US007835661B2

(12) United States Patent
Idehara et al.

(10) Patent No.: US 7,835,661 B2
(45) Date of Patent: Nov. 16, 2010

(54) IMAGE FORMING APPARATUS

(75) Inventors: Ryoh Idehara, Hyogo (JP); Nobuhiko Kita, Osaka (JP); Sei Onuma, Osaka (JP); Kazuyoshi Kondo, Osaka (JP); Yuusuke Furuichi, Osaka (JP); Genta Hagiwara, Ibaraki (JP); Kaoru Tada, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 505 days.

(21) Appl. No.: 12/000,968

(22) Filed: Dec. 19, 2007

(65) Prior Publication Data

US 2008/0253796 A1 Oct. 16, 2008

(30) Foreign Application Priority Data

Jan. 10, 2007 (JP) ..... 2007-002392

(51) Int. Cl.
*G03G 21/20* (2006.01)
*G03G 15/00* (2006.01)

(52) U.S. Cl. ..... 399/92; 399/94; 399/118

(58) Field of Classification Search ..... 399/92, 399/94, 95, 118

See application file for complete search history.

(56) References Cited

U.S. PATENT DOCUMENTS 5,659,847 A * 8/1997 Tsuda et al. ..... 399/113
6,785,502 B2 8/2004 Kondoh
7,400,842 B2 * 7/2008 Takehara et al. ..... 399/92
7,705,871 B2 * 4/2010 Imamura et al. ..... 347/242

FOREIGN PATENT DOCUMENTS

| | | |
|---|---|---|
| JP | HEI 7-191593 | 7/1995 |
| JP | 2849978 | 11/1998 |
| JP | 2002-318522 | 10/2002 |
| JP | 2004-361826 | 12/2004 |
| JP | 2006-058454 | 3/2006 |
| JP | 2006-079014 | 3/2006 |

* cited by examiner

*Primary Examiner*—David M Gray
*Assistant Examiner*—Joseph S Wong
(74) *Attorney, Agent, or Firm*—Harness, Dickey & Pierce, P.L.C.

(57) ABSTRACT

An image writing unit causes, upon being set in a write position, an optical system unit to be movable and positions the optical system unit, with a hitting portion of the optical system unit hitting a blocking portion in a chassis. A holding unit includes, in a state in which the image writing unit is set in the write position, a portion defining an opening that faces either one of an air intake unit and an air exhaust unit. The air intake unit blows an intake air to the optical system unit through the opening, or the air exhaust unit draws an exhaust air around the optical system unit through the opening.

14 Claims, 8 Drawing Sheets

IMAGE FORMING APPARATUS

CROSS-REFERENCE TO RELATED APPLICATIONS

The present application claims priority to and incorporates by reference the entire contents of Japanese priority document 2007-002392 filed in Japan on Jan. 10, 2007.

BACKGROUND OF THE INVENTION

1. Field of the Invention

The present invention relates to an image forming apparatus capable of retracting a image writing unit that includes an optical system unit containing optical components from a write position to a retract position, and a holding unit supported by a supporting unit while holding the optical system unit in a movable manner.

2. Description of the Related Art

Such an image forming apparatus is known as described in, for example, Japanese Patent No. 2849978. The image forming apparatus holds, on its opening and closing door that opens and closes a maintenance opening of a chassis, a image writing unit that writes a latent image to a image carrier such as a photosensitive element by scanning with write light. By retracting the image writing unit from inside the chassis according to opening of the opening and closing door, a processing unit that has been hidden behind the image writing unit is exposed. With this structure, the image writing unit is pulled out of the chassis according to opening of the opening and closing door, and the processing unit is exposed out of the maintenance opening, providing improved maintenance. Besides this structure, the detachable image writing unit exposed to the outside may be pulled out from the maintenance opening as necessary, so that devices having been hidden behind the image writing unit are exposed. The maintenance can be improved even with this structure.

On the other hand, the optical system unit of the image writing unit easily degrades write accuracy due to temperature increase. When the temperature in the apparatus increases as a rotating polygon mirror for deflecting the write light is driven, a lens and mirrors are thermally expanded, causing the light path of the write light to slightly fluctuate. In an image forming apparatus described in Japanese Patent Laid-open No. 2002-318522, an intake fan for taking the outside air into the chassis is coupled to an optical system unit through ducts, so that the optical system unit is cooled by airflow. At the connecting parts of the ducts and the optical system unit, the ducts cover the outer surface of the optical system unit, and the airflow inside the ducts cools the optical system unit while moving along and being in contact with the outer surface of the unit. The cooling can suppress degradation in write accuracy due to temperature increase in the optical system unit.

However, pulling the ducts in the chassis causes difficulties in downsizing the apparatus.

Cooling the optical system unit is possible without using the ducts, by fixing the optical system unit at the right front of the intake fan with, for example, a metal frame so as to receive the airflow directly through the intake fan.

In the image forming apparatus described in Japanese Patent No. 2849978 and those allowing their late image writing devices to be movable and detachable, use of such a cooling system has been difficult due to the following reason. Specifically, an optical system unit that performs light scan with a precise pitch such as a several tens of micrometer order is required to perform high-accuracy positioning in the chassis of the image forming apparatus. Thus, to allow the image writing unit to be movable or detachable, it is desirable to use an image writing unit capable of holding an optical system unit to be freely movable on a holding unit. This is because, when setting the image writing unit to its write position, the optical system unit can be positioned in the chassis by causing the optical system unit to freely move on a holding unit with its predetermined hitting portion hitting a blocking portion in the chassis. In this structure, however, the optical system unit is surrounded by the holding unit, causing difficulties in allowing the airflow from the intake fan to directly hit the optical system unit.

SUMMARY OF THE INVENTION

It is an object of the present invention to at least partially solve the problems in the conventional technology.

An image forming apparatus according to one aspect of the present invention includes an image carrier on which a latent image is formed; an image writing unit that writes the latent image on a surface of the image carrier with a write light output in a state in which the image writing unit is set in a write position; a supporting unit that supports the image writing unit in such a manner that the image writing unit is retractable from the write position; a developing device that develops the latent image formed on the image carrier to obtain a visible image; a chassis that contains the image carrier, the image writing unit, and the developing device; and either one of an air intake unit that generates intake air by sending air into the chassis from outside and an air exhaust unit that generates exhaust air by sending air from inside of the chassis to the outside. The image writing unit includes an optical system unit containing an optical system element in a unit case and a holding unit that holds the optical system unit in a movable manner, the holding unit being supported by the supporting unit. The image writing unit causes, upon being set in the write position, the optical system unit to be movable and positions the optical system unit, with a hitting portion of the optical system unit hitting a blocking portion in the chassis. The holding unit includes, in the state in which the image writing unit is set in the write position, a portion defining an opening that faces either one of the air intake unit and the air exhaust unit. The air intake unit blows the intake air to the optical system unit through the opening, or the air exhaust unit draws the exhaust air around the optical system unit through the opening.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. The following describes an embodiment of an electrophotographic printer (hereinafter, "a printer") serving as an image forming apparatus, to which the present invention is applied.

Figure 1:
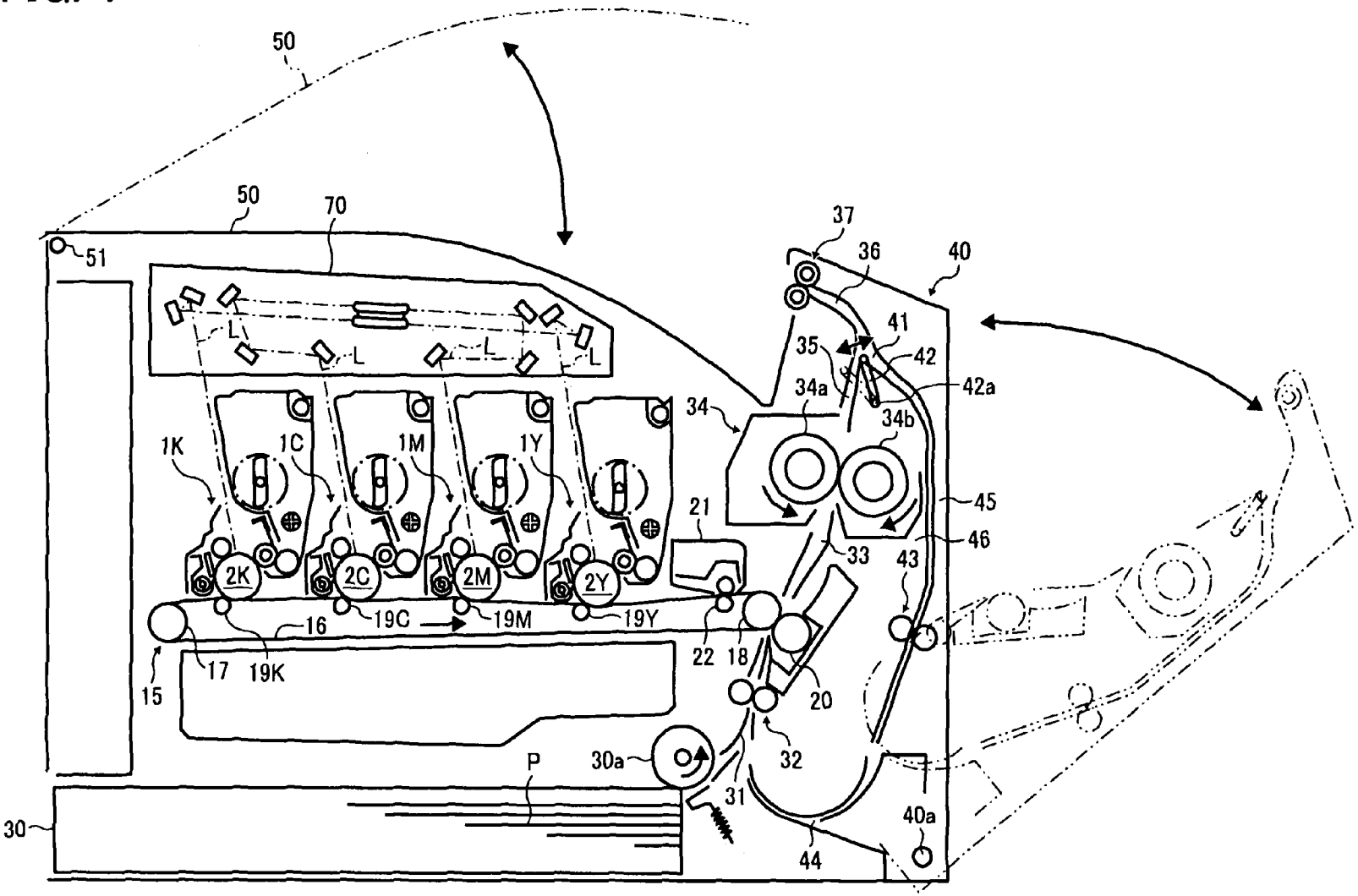
FIG. 1 is a schematic diagram showing a structure of a printer according to an embodiment of the present invention.
Figure 2:
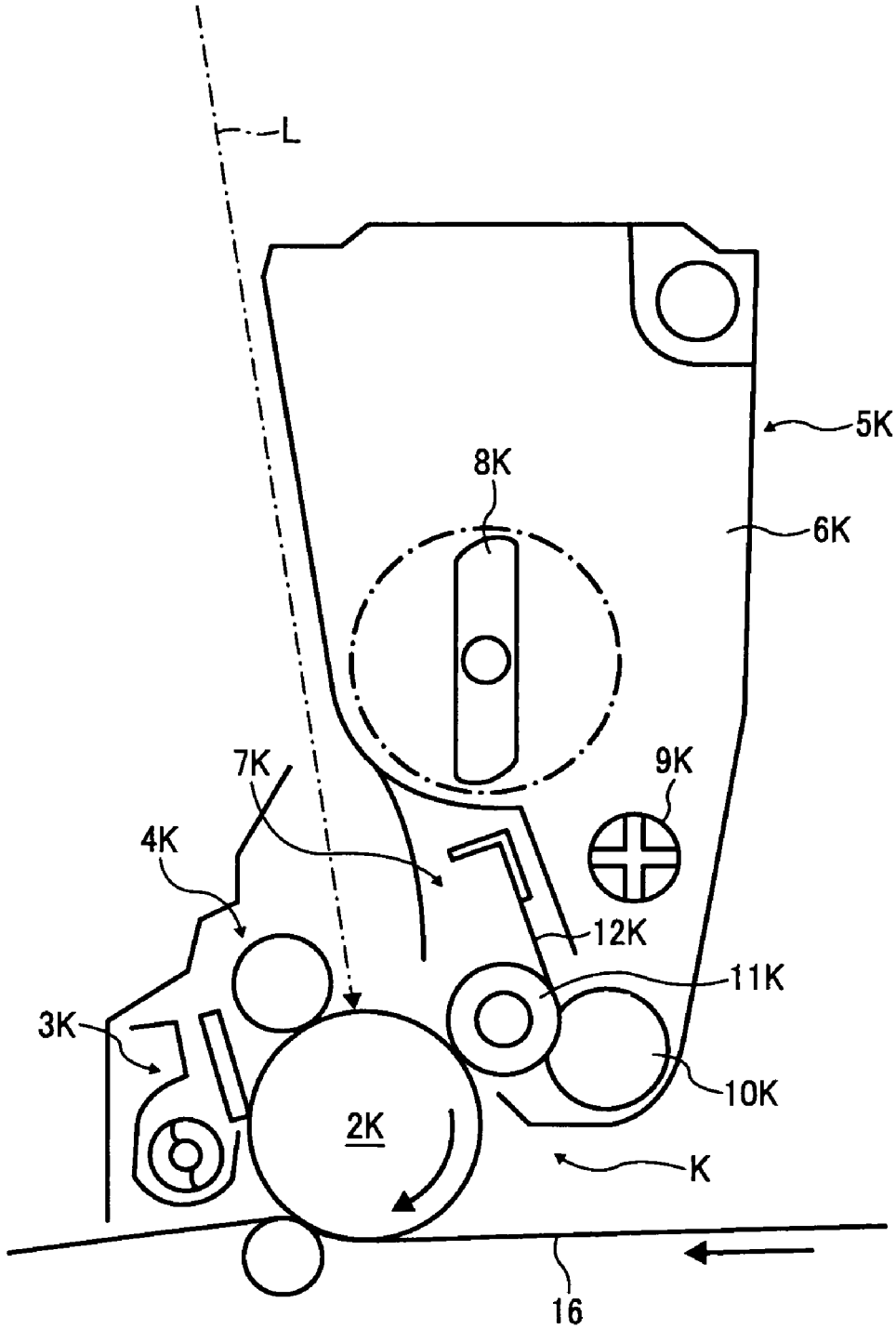
FIG. 2 is an enlarged configuration diagram of a processing unit for K of the printer shown in FIG. 1.

A basic structure of the printer will now be described. FIG. 1 is a schematic diagram of the printer. In FIG. 1, the printer includes four processing units 1Y, 1M, 1C, and 1K that form yellow, magenta, cyan, and black (hereinafter, "Y", "M", "C", and "K") toner images, respectively. The processing units use, as image forming materials, different color toners Y, M, C, and K, which are replaced when finishing their life. The other structures of the processing units are the same as each other. As shown in FIG. 2, for example, the processing unit 1K that forms a K toner image includes a drum photosensitive element 2K serving as an image carrier, a drum cleaning unit 3K, a neutralizing unit (not shown), a charging unit 4K, and a developing device 5K. These components are integrally and detachably formed to a main body of the printer, allowing consumables to be replaced at one time.

The charging unit 4K uniformly charges a surface of the photosensitive element 2K, which is rotated in a clockwise direction in the figure by a driving unit (not shown). The uniformly charged surface of the photosensitive element 2K is subjected to exposure scanning with laser light L, so as to carry a static latent image for K. This static latent image for K is developed to be a K toner image by the developing device 5K using a K toner (not shown), and intermediately transferred to an intermediate transfer belt 16 described later.

The drum cleaning unit 3K removes transfer residual toner adhered to the surface of the photosensitive element 2K having undergone the intermediate transfer process. The neutralizing unit neutralizes residual charges on the photosensitive element 2K having been cleaned. By removing the charge as such, the surface of the photosensitive element 2K is initialized to be ready for the next image formation. As to the other processing units (1Y, 1M, and 1C), (Y, M, and C) toner images are respectively formed on the photosensitive elements (2Y, 2M, and 2C), and intermediately transferred to the intermediate transfer belt 16 described later.

The developing device 5K includes a vertically long hopper unit 6K that contains a K toner (not shown), and a developing unit 7K. In the hopper unit 6K are provided an agitator 8K that is rotationally driven by a driving unit (not shown), a stirring paddle 9K that is rotationally driven vertically below the hopper unit 6K by a driving unit (not shown), a toner supplying roller 10K that is rotationally driven vertically below the stirring paddle 9K by a driving unit (not shown).

The K toner in the hopper unit 6K moves toward the toner supplying roller 10K by its own weight, while being agitated by rotational drive of the agitator 8K and the stirring paddle 9K. The toner supplying roller 10K includes a metal cored bar and a roller section that includes resin foam applied on a surface of the cored bar. The toner supplying roller 10K rotates, with the K toner in the hopper unit 6K adhered to the surface of the roller section.

In the developing unit 7K of the developing device 5K include a developing roller 11K that rotates while being in contact with the photosensitive element 2K and the toner supplying roller 10K, and a thinning blade 12K that brings its tip into contact with a surface of the developing roller 11K. The K toner adhered to the toner supplying roller 10K in the hopper unit 6K is supplied to the surface of the developing roller 11K at a contact portion between the developing roller 11K and the toner supplying roller 10K. The K toner thus supplied is regulated regarding its thickness on the surface of the roller, when passing through a contact portion between the roller and the thinning blade 12K according to the rotation of the developing roller 11K. The K toner of the regulated thickness is then adhered to a static latent image for K on the surface of the photosensitive element 2K at a developing area, i.e., a contact portion between the developing roller 11K and the photosensitive element 2K. With the adhesion, the static latent image for K can be developed to be a K toner image.

Although the foregoing describes the processing unit for K referring to FIG. 2, the same process is also applied to the processing units 1Y, 1M, and 1C for Y, M, and C, so that Y, M, and C toner images are developed on the surfaces of the photosensitive elements 2Y, 2M, and 2C, respectively.

In FIG. 1, vertically above the processing units 1Y, 1M, 1C, and 1K is provided an optical writing unit 70. The optical writing unit 70, serving as a image writing unit, performs light scanning on the photosensitive elements 2Y, 2M, 2C, and 2K in the processing units 1Y, 1M 1C, and 1K with the laser light L emitted from a laser diode based on image information. By the light scanning, static latent images for Y, M, C, and K are formed on the photosensitive elements 2Y, 2M, 2C, and 2K, respectively. The optical writing unit 70 deflects the laser light (L) emitted from the light source in a main scan direction using a polygon mirror that is rotationally driven by a polygon motor (not shown), so as to direct the light to the photosensitive elements via a plurality of optical lenses and mirrors. An optical writing unit that uses LED light emitted from a plurality of LEDs of LED array may be employed.

Vertically below the processing units 1Y, 1M, 1C, and 1K is provided a transfer unit 15 that causes the endless intermediate transfer belt 16 to be stretched and endlessly move in a counterclockwise direction in the figure. The transfer unit 15 serving as a transfer means includes not only the intermediate transfer belt 16, but also a driving roller 17, a following roller 18, four primary transfer rollers 19Y, 19M, 19C, and 19K, a secondary transfer roller 20, a belt cleaning unit 21, and a cleaning backup roller 22.

The intermediate transfer belt 16 is stretched by the driving roller 17, the following roller 18, the cleaning backup roller 22, and the primary transfer rollers 19Y, 19M, 19C, and 19K, all provided inside the loop of the intermediate transfer belt 16. Further, the intermediate transfer belt 16 is endlessly moved by a rotational force of the driving roller 17, which is rotationally driven in the counterclockwise direction in the figure by a driving unit (not shown), in the same direction as the rotation of the driving roller 17.

The primary transfer rollers 19Y, 19M, 19C, and 19K nip the endlessly moved intermediate transfer belt 16 with the photosensitive elements 2Y, 2M, 2C, and 2K. With the nipping, primary transfer nips for Y, M, C, and K are formed where an upper surface of the intermediate transfer belt 16 comes in contact with the photosensitive elements 2Y, 2M, 2C, and 2K.

To the primary transfer rollers 19Y, 19M, 19C, and 19K, a primary transfer bias is applied by a transfer biasing power source (not shown), thereby generating transfer fields between electrostatic latent images on the photosensitive elements 2Y, 2M, 2C, and 2K and the primary transfer rollers 19Y, 19M, 19C, and 19K, respectively. Instead of the primary transfer rollers 19Y, 19M, 19C, and 19K, a transfer charging unit, a transfer brush, or the like may be used.

The Y toner image formed on the surface of the photosensitive element 2Y of the processing unit 1Y for Y is advanced to the primary transfer nip for Y according to the rotation of the photosensitive element 2Y. The Y toner image is then transferred from the photosensitive element 2Y to the intermediate transfer belt 16 due to the transfer field and nip pressure. When the intermediate transfer belt 16 having the Y toner image primary-transferred thereto passes through the primary transfer nips for M, C, and K according to its endless movement, M, C, and K toner images on the photosensitive elements 2M, 2C, and 2K are sequentially superimposed on the Y toner image and primary-transferred. Through the primary transfer of the superposition, the four toner images are formed on the intermediate transfer belt 16.

The secondary transfer roller 20 of the transfer unit 15 is provided outside the loop of the intermediate transfer belt 16, and nips the intermediate transfer belt 16 with the following roller 18 provided inside the loop. With the nipping, a secondary transfer nip is formed where the upper surface of the intermediate transfer belt 16 comes in contact with the secondary transfer roller 20. To the secondary transfer roller 20, a secondary transfer bias is applied by a transfer biasing power source (not shown). With the application, a secondary transfer field is formed between the secondary transfer roller 20 and the following roller connected to ground.

Vertically below the transfer unit 15, a paper feed cassette 30 containing a bundle of a plurality of stacked recording sheets P is provided slidably and detachably to the chassis of the printer. The paper feed cassette 30 brings a paper feed roller 30*a* into contact with the top recording sheet P of the bundle, and sends the recording sheet P to a paper feed path 31 by rotating the paper feed roller 30*a* in the counterclockwise direction in the figure in a predetermined timing.

Near the end of the paper feed path 31 are provided a pair of resist rollers 32. The pair of resist rollers 32 stop rotating immediately after nipping the recording sheet P sent from the paper feed cassette 30. Further, the pair of resist rollers 32 restarts rotation driving with a timing in synchronization with the four toner images on the intermediate transfer belt 16 in the secondary transfer nip, so as to send the recording sheet P to the second transfer nip.

The four toner images on the intermediate transfer belt 16, closely adhered to the recording sheet P at the secondary transfer nip, are secondary transferred to the recording sheet P at one time due to the secondary transfer field and nip pressure, and then combined with the white color of the recording sheet to become a full-color toner image. The recording sheet P having the full-color toner image formed thereon is self-stripped from the secondary transfer roller 20 and the intermediate transfer belt 16, when passing through the secondary transfer nip. The recording sheet P is then sent to a fixing unit 34 (described later) through a post-transfer conveying path 33.

The intermediate transfer belt 16 having passed through the secondary transfer nip has transfer residual toner thereon that has not been transferred to the recording sheet P. The residual toner is cleaned from the surface of the belt by the belt cleaning unit 21 being in contact with the upper surface of the intermediate transfer belt 16. The cleaning backup roller 22, provided inside the loop of the intermediate transfer belt 16, backs up from inside the loop the belt cleaning unit 21 to clean the belt.

The fixing unit 34 forms a fixing nip between a fixing roller 34*a* that contains a heat generating source such as a halogen lamp (not shown) and a pressure roller 34*b* that rotates while being in contact with the fixing roller 34*a* with a predetermined pressure. The recording sheet P sent in the fixing unit 34 is nipped by the fixing nip so that its surface carrying an unfixed toner image is closely adhered to the fixing roller 34*a*. Further, the toner in the toner image is softened due to heat and pressure applied thereon, and the full-color image is fixed.

The recording sheet P discharged from the fixing unit 34 passes through a post-fixing conveying path 35, and then reaches a branch point between a paper discharge path 36 and a pre-reverse conveying path 41. Beside the post-fixing conveying path 35 is provided a switching nail 42 that is rotationally driven about a rotational axis 42*a*. The rotation of the switching nail 42 opens and closes the post-fixing conveying path 35 around its end. At a timing when the recording sheet P is sent from the fixing unit 34, the switching nail 42 stops at a rotational movement point indicated by a solid line in the figure, leaving the end of the post-fixing conveying path 35 opened. This process allows the recording sheet P to advance from the post-fixing conveying path 35 in the paper discharge path 36 and be nipped between a pair of discharge rollers 37.

When a single-sided printing mode is set according to an input operation made to an operation section such as a numeric key (not shown) or a control signal sent from a computer or the like (not shown), the recording sheet P nipped between the pair of discharge rollers 37 is left discharged to the outside of the apparatus. The recording sheet P is then stacked on a sheet stacking section, which is an outer surface section of an upper cover 50 of the chassis.

In a double-sided printing mode, on the other hand, the recording sheet P is transported in the paper discharge path 36 with its top end nipped between the pair of discharge rollers 37. When the tail end of the recording sheet P passes through the post-fixing conveying path 35, the switching nail 42 rotationally moves to a point indicated by a dashed line in the figure, causing the post-fixing conveying path 35 to close around its end. Almost concurrently, the pair of discharge rollers 37 starts a reverse rotation. Accordingly, the recording sheet P is transported with its tail end directed to its head; and advanced in the pre-reverse conveying path 41.

In FIG. 1, one side-end of the printer serves as a reversing unit 40 capable of opening and closing with respect to the main body of the chassis by pivoting about a pivot axis 40*a*. According to the reverse rotation of the pair of discharge rollers 37, the recording sheet P is advanced in the reversing unit 40 and transported vertically from the upper side to the lower side. After having passed through a pair of reverse transfer rollers 43, the recording sheet P advances in a reverse conveying path 44 curved in a semicircle. The recording sheet P is transported along the semicircle with its upper and lower surfaces reversed and also with its advance direction reversed vertically from the upper side to the lower side. In this way, the recording sheet P is transported vertically from the lower side to the upper side. The recording sheet P then passes through the paper feed path 31, and advances in the secondary transfer nip again. The recording sheet P receives full-color images that are secondary transferred to the other side thereof at one time, and then sequentially passes through the post-transfer conveying path 33, the fixing unit 34, the post-fixing conveying path 35, the paper discharge path 36, and the pair of discharge rollers 37, so as to be discharged to the outside of the apparatus.

The reversing unit 40 includes an outer cover 45 capable of pivoting with respect to the main body of the chassis, and a second pivoting element 46 capable of pivoting with respect to the outer cover 45. Specifically, the outer cover 45 of the reversing unit 40 is supported so as to pivot about the pivot axis 40*a* provided in the chassis of the main body of the printer. The pivoting movement allows the outer cover 45 to open and close with respect to the chassis together with the second pivoting element 46 held in the outer cover 45. When the outer cover 45 is opened together with the second pivoting element 46 as indicated by dotted lines in FIG. 1, the paper feed path 31, the secondary transfer nip, the post-transfer conveying path 33, the fixing nip, the post-fixing conveying path 35, the paper discharge path 36, all formed between the reversing unit 40 and the main body of the printer, are vertically divided and exposed to the outside. This process facilitates removal of a paper jammed in the paper feed path 31, the secondary transfer nip, the post-transfer conveying path 33, the fixing nip, the post-fixing conveying path 35, or the paper discharge path 36.

The second pivoting element 46 is supported by the outer cover 45 so as to pivot about a pivot axis (not shown) provided on the outer cover 45, when the outer cover 45 is opened. When the second pivoting element 46 is opened toward the outer cover 45 according to the pivoting movement, the pre-reverse conveying path 41 and the reverse conveying path 44 are vertically divided and exposed to the outside. This process facilitates removal of a paper jammed in the pre-reverse conveying path 41 or the reverse conveying path 44.

The upper cover 50 of the chassis of the printer serves as an opening and closing door of the chassis. Further, the upper cover 50 is supported to be pivotable about an axis member 51 as indicated by arrows in the FIG. 1, and opens with respect to the chasses when rotated by a predetermined degree in the counterclockwise direction in the figure. The maintenance opening of the chassis is then opened.

The processing units 1Y, 1M, 1C, and 1K are provided above the intermediate transfer belt 16, above which the optical writing unit 70 is further provided. In this layout, to attach and detach the processing units 1Y, 1M, 1C, and 1K via the maintenance opening, the optical writing unit 70 needs to be retracted from directly above the processing units 1Y, 1M, 1C, and 1K. In the printer of this type allowing the upper cover 50 to be opened, to retract the optical writing unit 70, the optical writing unit 70 may be supported with frames in the chassis to be vertically slidable, so as to be detached in the vertical direction. Further, one end of the optical writing unit 70 may be supported with frames in the chassis to be pivotable, so as to be retracted directly from above the processing units or be set directly above the processing units according to its pivoting movement. Furthermore, the optical writing unit 70 may be held on a lower surface of the upper cover 50 capable of opening and closing, so as to be retracted from directly above the processing units or be set directly above the processing units according to opening and closing of the upper cover 50.

In any of the arrangements, crank movement of the optical writing unit 70 capable of sliding or pivoting movement, or crank movement of the upper cover 50 causes an error in relative position between the optical writing unit 70 and the photosensitive elements 2Y, 2M, 2C, and 2K in the chassis. This error degrades accuracy of the write position of the optical writing unit 70. The degradation in accuracy of the write position causes an image blur, an image missing, a shading, and the like. Further, such errors cause color misregistration in the printer including a plurality of processing units.

Figure 3:
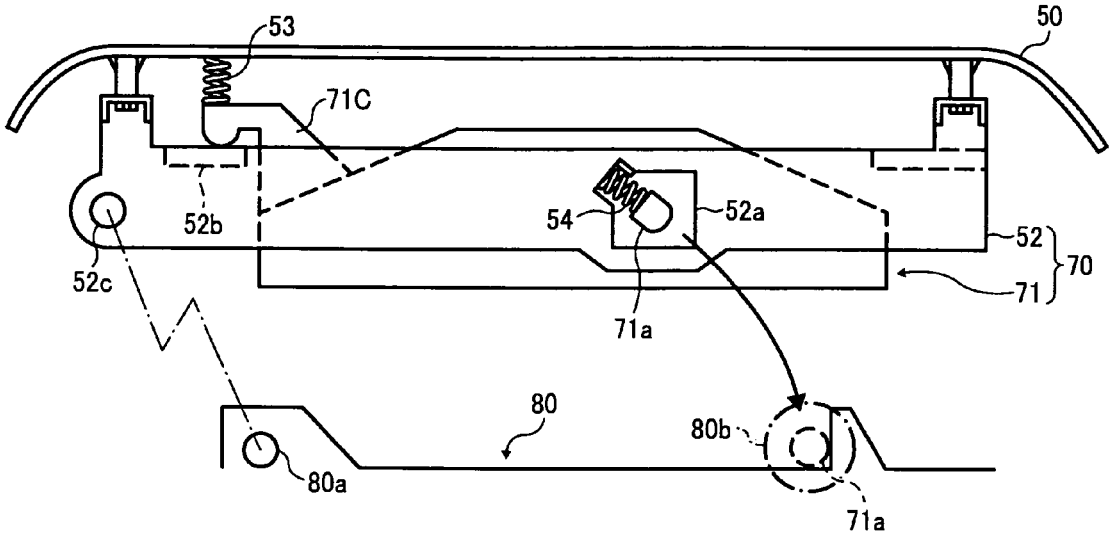
FIG. 3 is an enlarged configuration diagram showing an upper cover and its surrounding structure of the printer shown in FIG. 1.

FIG. 3 is an enlarged configuration diagram showing the upper cover 50 of the printer and its surrounding structure. In FIG. 3, on the rear surface of the upper cover 50 is fixed the optical writing unit 70 that includes a cover frame 52 serving as a holding unit, and an optical system unit 71. The cover frame 52 includes plate-like first and second frames that face each other with a predetermined distance in between in a direction orthogonal to the surface of the figure and third and fourth frames (not shown) that couple the first and the second frames. To the first and the second frames, rectangular retaining openings 52*a* are provided so as to face each other.

On the other hand, the optical system unit 71 includes a first reference positioning member 71*a* formed in a cylinder and provided to protrude from one side surface of a casing of the optical system unit 71. Although not shown in FIG. 3, the optical system unit 71 further includes a second reference positioning member formed in a cylinder and provided to protrude from the other side surface of the casing of the optical system unit 71. These reference positioning members are provided so as to extend on the same axis line. The optical system unit 71 positions between the first and the second frames of the cover frame 52. The first reference positioning member 71*a*, serving as a hitting portion and protruding from its one side surface, penetrates through the retaining opening 52*a* provided on the first frame of the cover frame 52. Although not shown in FIG. 3, the second reference positioning member protruding from the other side surface penetrates through an opening provided on the second frame of the cover frame 52. The optical system unit 71 further includes a hook unit 71*c* on its upper portion. The hook unit 71*c* is urged to be away from the upper cover 50 by a coil spring 53 fixed on the lower surface of the upper cover 50, and engaged with a latching unit 52*b* of the cover frame 52. As such, the optical system unit 71 is held in the cover frame 52 so that the first reference positioning member 71*a* protruding from the side surface and the second reference positioning member protruding from the other side surface penetrate through the openings of the cover frame 52, and that the hook unit 71*c* is engaged with the latching unit 52*b* of the cover frame 52. As the cover frame 52, the one integrally formed with its main body may be used.

The retaining opening 52*a* provided on the first frame of the cover frame 52, and the opening provided on the second frame (not shown) are larger in size than the diameter of the first reference positioning member 71*a* and the second reference positioning member (not shown) of the optical system unit 71. Accordingly, the optical system unit 71 is held in the cover frame 52 so as to freely move in a clearance between the first reference positioning member 71*a* and the retaining opening 52*a* of the first frame and in a clearance between the second reference positioning member and the opening of the second frame.

Figure 4:
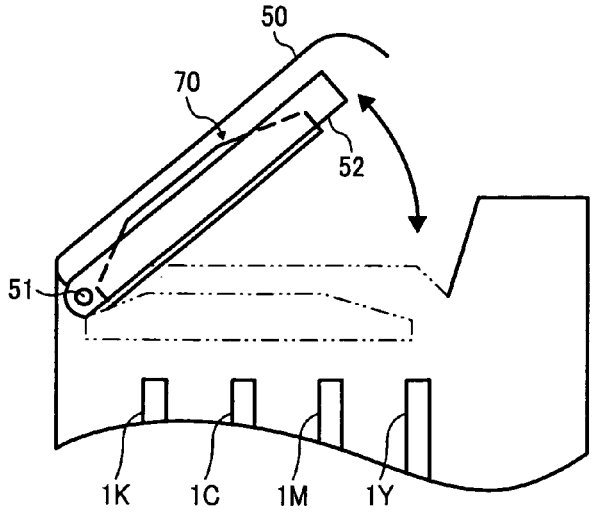
FIG. 4 is a drawing of opening and closing operations performed by the upper cover shown in FIG. 3.

On one ends of the first and the second frames of the cover frame 52 are formed axis holes 52*c*. On the other hand, on the main body of the cassis of the printer is provided a standing first side plate 80. Although not shown in FIG. 3, on the rear side of the first side plate 80 in the figure is provided a standing second side plate, which faces to the first side plate 80 with a predetermined distance. Further, on one ends of the first side plate 80 and the second side plate are provided axis holes (80*a* on the first side plate 80). One end of the cover frame 52 is inserted between the first side plate 80 and the second side plate. In this arrangement, an axis member (not shown in FIG. 3, 51 in FIG. 1) is set to sequentially penetrate through the axis hole 80*a* of the first side plate 80, the axis hole 52*c* of the first frame of the cover frame 52, the axis hole of the second frame of the cover frame 52, and the axis hole of the second side plate. In this way, the upper cover 50 and the optical writing unit 70 are supported by the supporting units, i.e., the first side plate (80) and the second side plate of the chassis, so as to pivot about the axis member 51 as shown in FIG. 4.

According to the opening and closing operation performed by the upper cover 50, the optical writing unit 70 held on the upper cover moves between a retract position, where the optical writing unit 70 does not face any of the laterally arranged processing units 1Y, 1M, 1C, and 1K, and a write position, where the optical writing unit 70 faces the processing units.

The first and the second frames of the cover frame 52 have hooks (not shown) thereon. When the upper cover 50 is closed, these hooks are engaged with extension pins (not shown) provided on the first side plate 80 and the second side plate of the chassis. With the engagement, pivoting movement of the cover frame 52 is latched.

In FIG. 3 as shown above, on the first frame of the cover frame 52 is fixed a first biasing coil spring 54 serving as a biasing unit that biases, from the upper left to the lower right direction, the first reference positioning member 71*a* penetrating through the retaining opening 52*a* of the cover frame 52. Although FIG. 3 depicts the first reference positioning member 71*a* positioned at the center of the retaining opening 52*a*, when the upper cover 50 is opened, the optical system unit 71 is held in the cover frame 52, and the first reference positioning member 71*a* is biased by the first biasing coil spring 54 to be pushed to a corner of the inner wall of the retaining opening 52*a*. Although not shown in FIG. 3, on the second frame of the cover frame 52 is fixed a second biasing coil spring serving as a second biasing unit. The second biasing unit biases the second reference positioning member penetrating through an opening of the second frame toward the inner wall of the opening.

Figure 5:
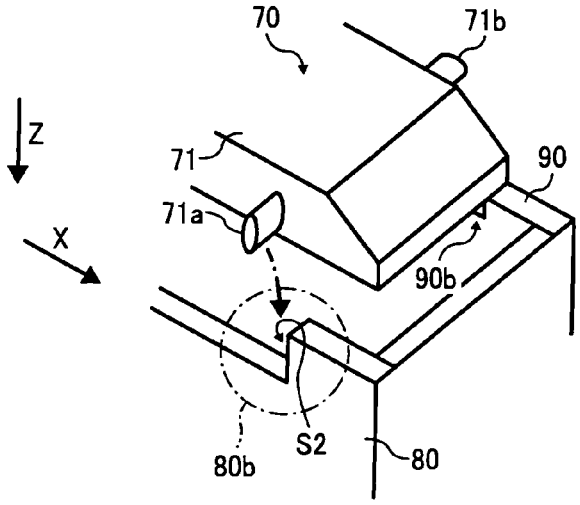
FIG. 5 is a perspective view of a right edge of a chassis of the printer shown in FIG. 1.
Figure 6:
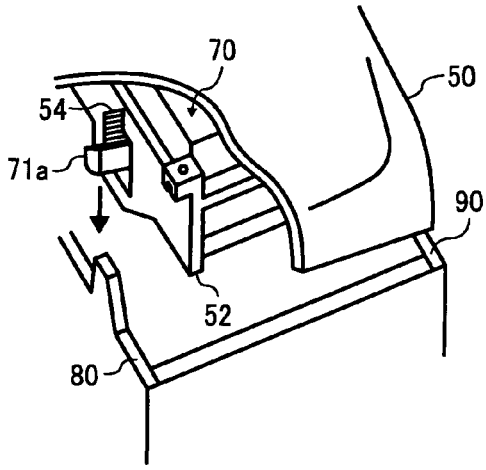
FIG. 6 is an exploded perspective view of the right edge of the printer shown in FIG. 1.

On the other hand, on the upper portion of the first side plate 80 in the chassis is provided a first positioning unit 80*b* serving as a blocking portion. As shown in FIGS. 5 and 6, the first positioning unit 80*b* blocks and thereby positions the optical system unit 71, which moves to the write position as the upper cover closes. The first positioning unit 80*b* has two contact surfaces that come in contact with the first reference positioning member 71*a* biased by the first biasing coil spring (54 in FIG. 6). The first contact surface is an X direction regulating contact surface S2 that regulates the movement of the first reference positioning member 71*a* in a direction indicated by an arrow X in FIG. 5. The direction indicated by the arrow X in FIG. 5 is orthogonal to a latent image write direction (main scan direction) of the optical writing unit 70, i.e., orthogonal to a direction perpendicular to the surface of the figure, and is parallel to the lateral direction (lateral direction in FIG. 5), i.e., a movement direction along the latent image write positions (light write positions) on the surfaces of the photosensitive elements in the chassis. The second contact surface is a Z direction regulating contact surface S3 that regulates the movement of the first reference positioning member 71*a* in a direction indicated by an arrow Z in the FIG. 5.

Figure 7:
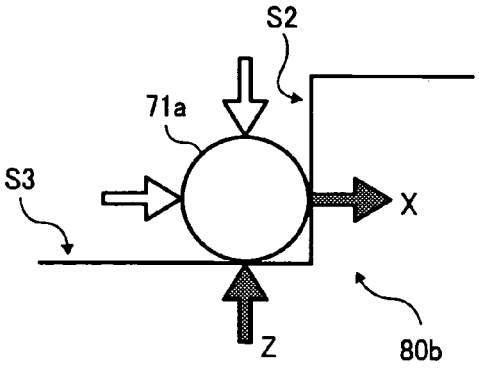
FIG. 7 is a drawing of a optical writing unit for the processing units shown in FIG. 4, with the first reference positioning member shown in FIG. 5 contacting the first positioning unit shown in FIG. 5 in the chassis.
Figure 8:
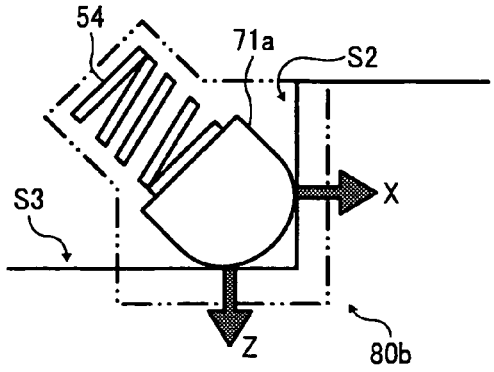
FIG. 8 is a drawing of the first reference positioning member biased by a first biasing coil spring and its surrounding structure.

As the first biasing coil spring (not shown) that biases the first reference positioning member 71*a*, springs may be separately provided for biasing the first reference positioning member 71*a* in the X direction and in the Z direction respectively, as indicated by an outline arrow in FIG. 7. However, this structure causes cost increase due to an increased number of coils, and upsizing of the apparatus. Cost reduction and downsizing are realized with the first biasing coil spring 54 biasing the first reference positioning member 71*a* to move in an oblique direction having X direction and Y direction movement components, as in the printer having the structure shown in FIG. 8. The same is applied to the second biasing coil that biases the second reference positioning member (not shown).

The first biasing coil spring 54 shown in FIG. 3 biases the first reference positioning member 71*a* of the optical system unit 71 being in the write position with the upper cover 50 closed, thereby striking it on the X direction regulating contact surface S2 and the Z direction regulating contact surface S3 of the first positioning unit 80*b* shown in FIG. 5. Accordingly, one end of the optical system unit 71 in the write position is positioned in both the X and the Z directions.

In FIG. 5, on the upper portion of a second rear side plate 90 facing the first side plate 80 of the chassis with a predetermined distance, a second positioning unit 90*b* is provided. The second positioning unit 90*b* serving as a blocking section that positions the optical system unit 71, which moves to its write position as the upper cover closes. The second positioning unit 90*b* has two contact surfaces that come in contact with a second reference positioning member 71*b* biased by the second biasing coil spring (not shown).

The second biasing coil spring fixed on the second frame (not shown) of the cover frame 52 biases the second reference positioning member 71*b* of the optical system unit 71 being in the write position, thereby striking the second reference positioning member 71*b* on both the X direction regulating contact surface and the Z direction regulating contact surface of the second positioning unit 90*b*. Accordingly, the other end of the optical system unit 71 in the write position is positioned in both the X and the Z directions.

In the printer having the structure, the optical writing unit 70 is moved from the write position to the retract position according to opening operation performed by the upper cover 50 as necessary, and thus largely detached from the processing units 1Y, 1M, 1C, and 1K containing the photosensitive elements and their surrounding devices. This detachment enables the processing units 1Y, 1M, 1C, and 1K to be exposed, providing improved maintenance for them.

By bringing the reference positioning members of the optical system unit 71 being in the write position into contact with the positioning sections in the chassis with a biasing force of the biasing coil springs, the optical system unit 71 is positioned with respect to the photosensitive elements in the chassis. Accordingly, even with some extent of crank movement of the cover frame 52, which serves as an opening and closing door and moves while holding the optical writing unit 70 to be movable, the optical system unit 71 is positioned at the write position with respect to the photosensitive elements in the chassis. This structure suppresses degradation in accuracy of the write position of the optical system unit 71.

The following describes a characteristic structure of the printer according to the embodiment.

Figure 9:
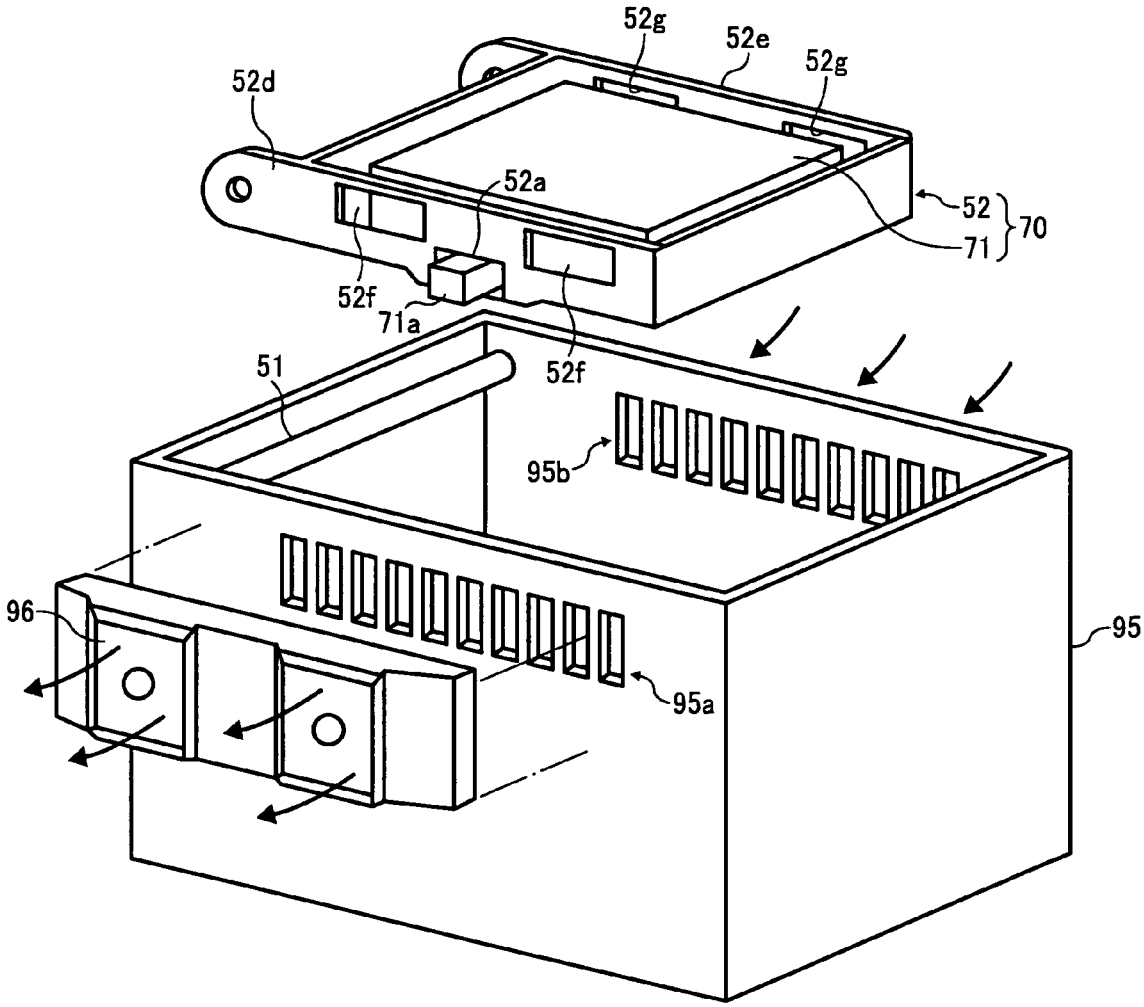
FIG. 9 is a perspective view showing an outer cover constituting a part of the chassis of the printer, and the optical writing unit taken out from inside the chassis.
Figure 10:
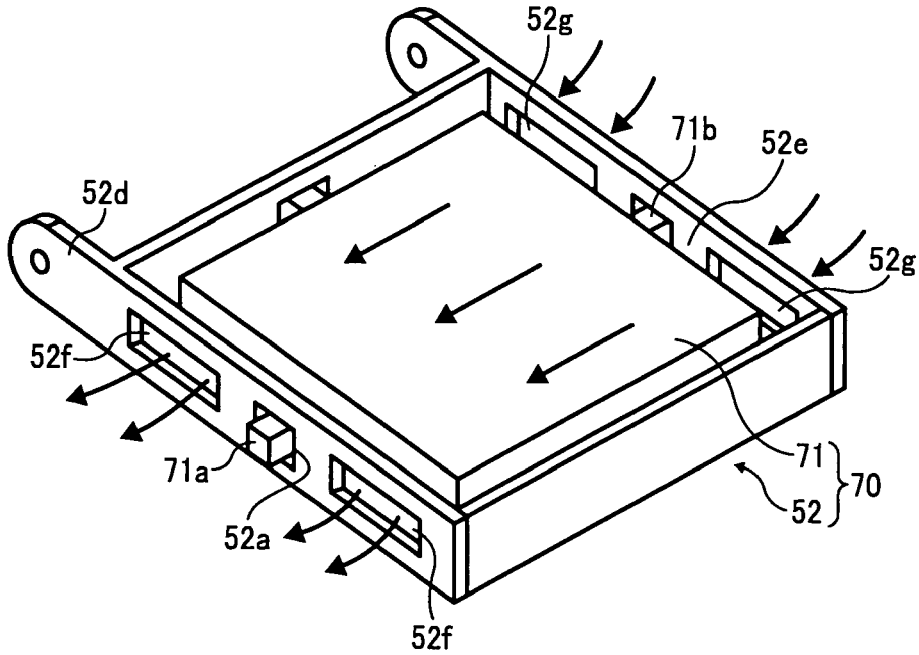
FIG. 10 is a perspective view of the optical writing unit.

FIG. 9 is a perspective view showing an outer cover 95 constituting a part of the chassis of the printer, and the optical writing unit 70 taken out from the chassis. FIG. 10 is a perspective view of the optical writing unit 70. In FIG. 9, on a rear surface of the outer cover 95 is formed an outlet group 95*a* including a plurality of exhaust outlets. Exhaust fans 96 serving as air exhaust units are attached so as to cover the outlet group 95*a* from the outside. On the other hand, on a front surface of the outer cover 95 is formed an inlet group 95*b* including a plurality of inlets, facing the outlet group 95*a* provided on the rear surface.

The exhaust fans 96 draw the air in the chassis and discharge it to the outside of the chassis via the outlet group 95*a*. According to the discharging, air is drawn from the inlet group 95*b* provided on the front surface of the outer cover 95 into the chassis, thereby generating airflow from the inlet group 95*b* to the outlet group 95*a* in the chassis.

Although not shown in FIG. 3 for convenience, on a first frame 52*d* of the cover frame 52 serving as a holding unit are disposed the retaining opening 52*a*, through which the first reference positioning member 71*a* of the optical system unit 71 penetrates, and two first air openings 52*f*. On a second frame 52*e* of the cover frame 52 are disposed the opening, through which the second reference positioning member 71*b* of the optical system unit 71 penetrates, and two second air openings 52*g* serving as second openings.

The cover frame 52 serving as a holding unit constitutes a rectangular frame member with the first, the second, the third, and the fourth frames forming no sealed space therein, and holds the optical system unit 71 inside the frame body. Whereas FIG. 10 depicts the optical writing unit 70 taken out from the chassis, when the optical writing unit 70 is set in the write position, the first air openings 52*f* provided on the first frame 52*d* of the cover frame 52 face the exhaust fans 96 via the outlet group 95*a* of the outer cover 95, and the second air openings 52*g* provided on the second frame 52*e* of the cover frame 52 face the inlet group 95*b* of the outer cover.

When the exhaust fans 96 are driven with the components facing each other, the air around the optical system unit 71 held in the cover frame 52 is drawn by the exhaust fans 96 through the first air openings 52*f* of the first frame 52*d*. Accordingly, airflow is generated around the optical system unit 71 and actively moves while being in contact with the surface of the unit case, thereby cooling the optical system unit 71 desirably. At the front of the chassis, a part of the air taken in the chassis from the inlet group 95*b* passes through the second air openings 52*g* provided on the second frame 52*e* of the cover frame 52 without being blocked by any members, and reaches an outer surface of the optical system unit 71. The part of the air is then drawn by the airflow generated on the surface of the unit case as the exhaust fans 96 is driven on the rear side in the chassis, and smoothly moves to the first air openings 52*f* provided on the first frame 52*d*. As such, a part of the air taken in the chassis from the inlet group 95*b* reaches the surface of the unit case without being blocked by any members, and is drawn to the first air openings 52*f*, allowing more active movement of the airflow on the surface of the unit case.

With the structure, degradation in write accuracy due to temperature increase in the optical system unit 71 can be suppressed by cooling the optical system unit 71 desirably, without pulling ducts inside the chassis.

The exhaust fans 96 may serve as intake fans by causing their blades to rotate in a reverse direction of the normal rotational direction. In this case, the inlet group 95*b* shown in FIG. 9 serves as an outlet group, and the outlet group 95*a* shown in FIG. 9 serves as an inlet group. By blowing the air taken by the intake fans directly to the optical system unit 71 through the first air openings 52*f* of the first frame 52*d*, active airflow may be generated on the surface of the unit case. A part of the airflow passes through the second air openings 52*g* of the second frame 52*e* and through the inlet group 95*b* of the outer cover 95 (serving as an outlet group in this case) without being blocked by any members. This structure desirably facilitates the movement of the airflow on the surface of the unit case.

The following describes printers according to first and second examples that have characteristic structures in addition to that of the printer according to the embodiment. The structures of the printers according to the first and second examples are the same as that of the embodiment if not otherwise specified.

Figure 11:
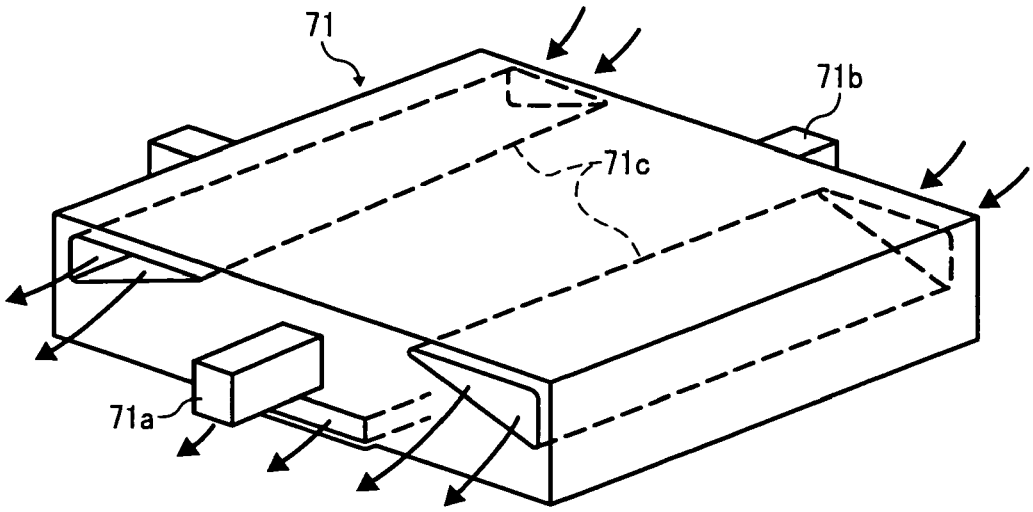
FIG. 11 is a perspective view of an optical system unit of a printer according to a first example of the present invention.

FIG. 11 is a perspective view showing the optical system unit 71 of a printer according to a first embodiment example of the present invention. The unit case of the optical system unit 71 includes two air paths 71*c* that extend from the rear side to the front side of an outer cover (not shown). Each of the air paths 71*c* is formed in a tubular shape penetrating through the unit case such that an inner wall of its tube is exposed to the outside air and an outer wall is in contact with the air inside the case. When airflow is generated in the air paths 71*c*, the air in the unit case is cooled by the tubes of the air paths 71*c*. With this structure, the optical system unit 71 can be cooled from inside the case.

Figure 12:
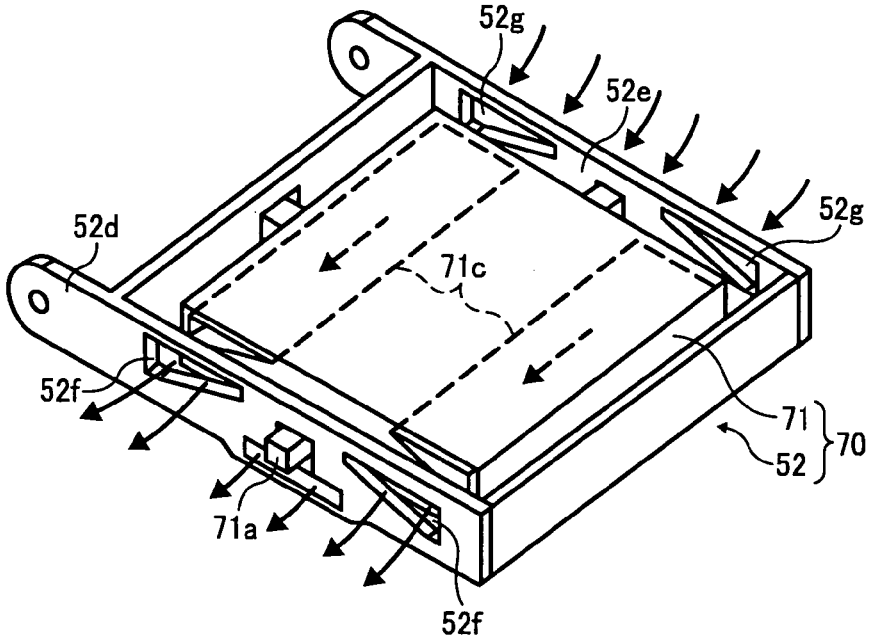
FIG. 12 is a perspective view of an optical writing unit of the printer.

FIG. 12 is a perspective view showing the optical writing unit 70 of the printer according to the first embodiment example. In FIG. 12, the cover frame 52 holds the optical system unit 71 to be in the following orientation. Specifically, openings at one ends of the respective air paths 71*c* of the optical system unit 71 (openings indicated by solid lines in FIG. 12), i.e., airflow outlets, are arranged to face the first air openings 52*f* formed on the first frame 52*d* of the cover frame 52, and openings at the other ends of the air paths 71*c* (openings indicated by dotted lines in FIG. 12), i.e., airflow inlets, are arranged to face the second air openings 52*g* formed on the second frame 52*e* of the cover frame 52.

With this structure, the exhaust fans can generate desirable airflow in the air paths 71*c* by drawing air in the air paths 71*c* through the first air openings 52*f* of the first frame 52*d*. By desirably receiving the air, drawn into the chassis from the inlet group of the outer cover (not shown) through the second air openings 52*g* of the second frame 52*e* and through the airflow inlets of the air paths 71*c*, the movement of the airflow in the air paths 71*c* can be facilitated desirably.

In the same manner as the printer according to the embodiment does, the printer according to the first embodiment example uses the photosensitive elements (2Y, 2M, 2C, and 2K) serving as image carriers that carry latent images on the peripheries of their rotatable cylinders (drum sections). Further, paths for the airflow from the inlet group (not shown in FIG. 12, 95*b* in FIG. 9) of the outer cover to the exhaust fans (not shown in FIG. 12, 96 in FIG. 9) through the second air openings 52*g* serving as the second openings, the air paths 71*c*, and the first air openings 52*f* serving as first openings are provided on straight lines along a rotational axis direction of the photosensitive elements. With this structure, the primary airflow generated in the air paths 71*c* formed in straight lines are moved in an extension direction of the air paths 71*c*. In addition, the secondary airflow generated in the air paths 71*c* is also moved in the extension direction of the air paths 71*c*. By bringing the secondary airflow flowing from one end to the other end of the axis direction into contact with the processing units (1Y, 1M, 1C, and 1K) that extend in the axis direction of the photosensitive elements, the processing units can be cooled desirably.

As described in the embodiment, a chassis serving as a supporting unit is used that supports the optical writing unit 70 to be pivotable between the write position and the retract position according to the pivoting movement of the upper cover (50). Further, the extension direction of the paths for the airflow is directed in a straight line along the axis direction of the pivoting movement of the optical writing unit 70. With this structure, the optical writing unit 70 can constantly pivot with its orientation parallel to the extension direction of the air paths 71*c*.

Figure 13:
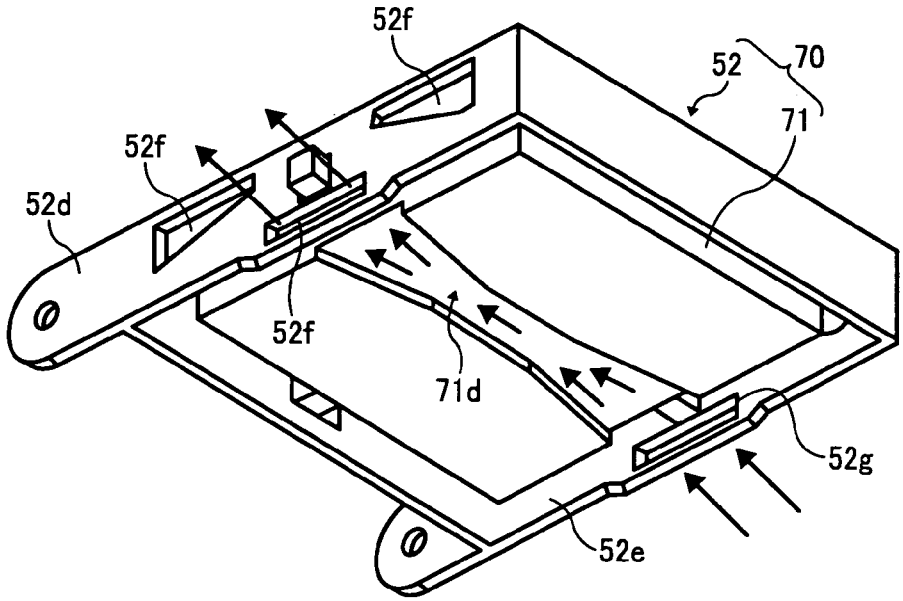
FIG. 13 is a perspective view of the optical writing unit shown in FIG. 12, shown from the lower side.

FIG. 13 is a perspective view of the optical writing unit 70 of the printer according to the first embodiment example, shown from the obliquely lower side. In FIG. 13, beneath the unit case of the optical system unit 71 is formed a depressed section, i.e., a groove-like air path 71*d* that extends in an anteroposterior direction of the printer. On the first frame 52*d* of the cover frame 52 are provided three first air openings 52*f*, one of which faces one end of the air path 71*d*. The other two first air openings 52*f* face the airflow outlets of the two air paths (71*c*) that penetrate through the unit case of the optical system unit 71. On the second frame 52*e* of the cover frame 52 are provided three alternate air openings 52*g*, one of which faces the other end of the air path 71*d*. With this structure, desirable airflow is generated in the air path 71*d*, so that the optical system unit 71 can be cooled from its lower side as well.

The air path 71*d* has a smaller cross section (volume) at its center part in the airflow direction than at its both ends. Thus, cooling effect can be improved for the center part by accelerating the flow velocity at the center part to be faster than that at the both ends. Cooling effect can also be improved for the center parts of the air paths (71*c*) with the same structure.

Figure 14:
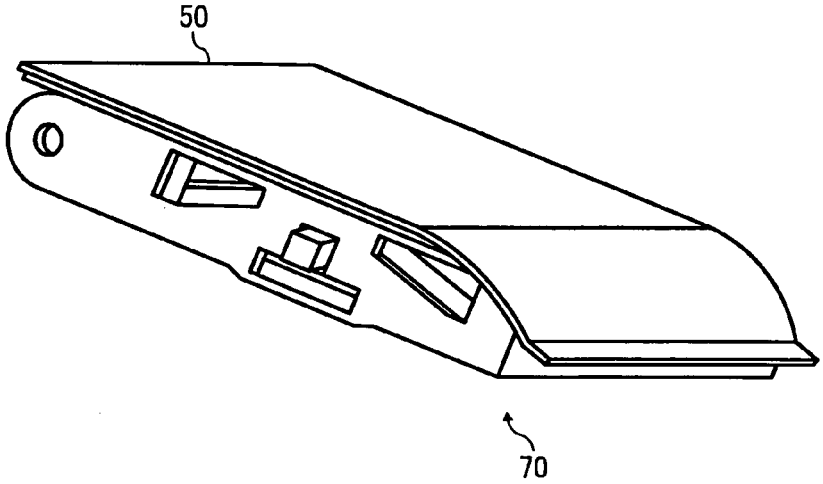
FIG. 14 is a perspective view of an upper door unit of a printer according to second example of the present invention.
Figure 15:
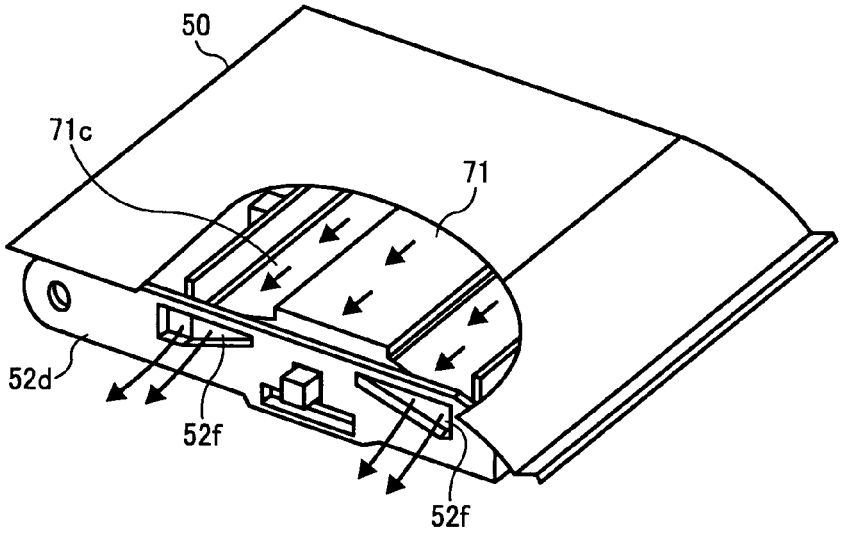
FIG. 15 is an exploded perspective view of the upper door unit shown in FIG. 14.
Figure 16:
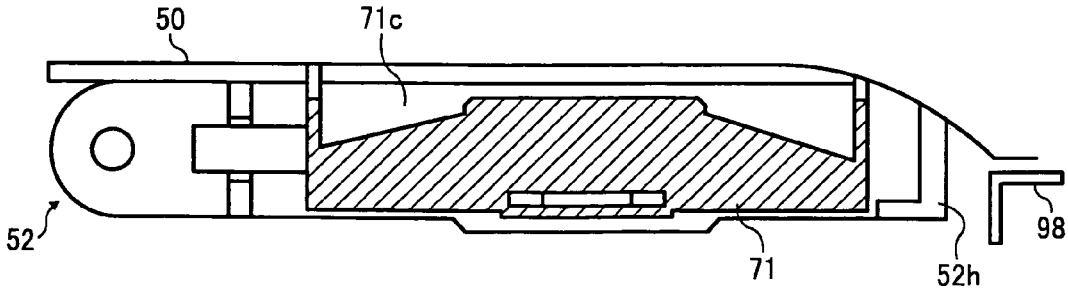
FIG. 16 is a side view of the upper door unit shown in FIG. 14, shown from the rear side of the printer.

FIG. 14 is a perspective view of an upper door unit of a printer according to a second embodiment example of the present invention. FIG. 15 is an exploded perspective view of the upper door unit. FIG. 16 is a side view of the upper door unit shown from the rear side of the printer. In FIGS. 14 to 16, the upper door unit includes the optical writing unit including the cover frame 52 and the optical system unit 71, and the upper cover 50 of the chassis.

As in the embodiment, the upper cover 50 constituting a part of the chassis and serving as an opening-and-closing cover is directly fixed to the optical writing unit 70. Further, an outer surface section of the upper cover 50 serves as a sheet stacking section on which the recording sheets P having undergone the printing process are staked.

As shown in FIG. 16, the upper portion of the unit case of the optical system unit 71 is formed to have complex depressions and bumps. The both edges of the unit case protrude toward the upper cover 50 and are connected to the rear surface of the cover so as to surround these depressions and bumps from both the left and the right sides of the printer. In this way, the air paths 71*c* are formed between the upper surface of the unit case and the lower surface of the upper cover 50.

The airflow in the air paths 71*c* moves while being in touch with the lower surface of the upper cover 50 and the upper surface of the unit case, thereby cooling the upper cover 50 from its lower side and the optical system unit 71 from its upper surface. With this structure, even when the heat is accumulated due to the large volume of the recording sheets P heated through the fixing process and stacked on the sheet stacking section, heat transfer from the upper cover 50 to the optical system unit 71 can be suppressed by cooling the upper cover 50.

The airflow inlets of the air paths 71*c* face the second air openings provided on the second frame (not shown) of the cover frame 52. The airflow outlets of the air paths 71*c* face the first air openings 52*f* provided on the first frame 52*d*, as shown in FIG. 15.

With the upper cover unit closed, a pivoting end of the upper cover 50 is placed over a left plate 98 constituting a part of the chassis, causing a space to be formed in between. This space is inevitably formed to allow a latching unit (not shown) of the upper cover unit to have crank movement to some extent and engage with a latching unit (not shown) used to latch the upper cover unit at the closed position. Through the space, the outside air is drawn into the chassis little by little as the exhaust fans (not shown) are driven.

When a small amount of the airflow drawn through the space is moved smoothly from the rear side to the front side of the outer case, occurrence of a turbulent flow is induced. As a result, the airflow originally used for cooling is inactivated. Thus, in the printer, a fourth frame 52*h* of the cover frame 52 serves as a facing member that faces a space between the upper cover 50 with the maintenance opening of the upper portion of the chassis closed and an upper end of the left plate 98 constituting a portion of the chassis and being close to the upper cover 50. With this structure, the fourth frame 52*h* can block the smooth the movement of the airflow drawn through the space, preventing degradation in cooling performance due to the occurrence of the turbulent flow.

The foregoing describes a printer of a one-component developer system that develops a latent image with a one-component developer mainly including toner without magnetic carrier. The present invention can also be applied to an image forming apparatus of a two-component developer system that uses a two-component developer including magnetic carrier and toner.

The printer according to the embodiment uses the cover frame 52 serving as a holding unit that constitutes a frame body forming no sealed space therein, and that holds the optical system unit 71 inside the frame body having thereon the first air openings 52*f* and the second air openings 52*g*. With this structure, inactivation of the air around the optical system unit 71 is reduced and cooling performance of the optical system unit 71 is improved, compared with a holding unit containing the optical system unit 71 in its inner sealed space.

Further, the printer according to the first embodiment example uses, as the unit case of the optical system unit 71, a unit case through which the tubular air paths 71*c* penetrate such that their inner walls contact the outside air of the case and their outer walls contact the inside air of the case. With this structure, the optical system unit 71 can be cooled from the inside.

In the printer according to the first embodiment example, the optical system unit 71 is held in the cover frame 52 such that the airflow inlets at one ends of the air paths 71*c* in the airflow direction face the second air openings 52*g* of the second frame 52*e* and that the airflow outlets at the other ends of the air paths 71*c* face the first air openings 52*f* of the first frame 52*d*. With this structure, the air in the air paths 71*c* is drawn through the first air openings 52*f* of the first frame 52*d* with the exhaust fans, so that desirable airflow can be generated in the air paths 71*c*. Further, the air drawn into the chassis from the inlet group 95*b* of the outer cover is received into the air paths 71*c* through the second air openings 52*g* of the second frame 52*e* and the airflow inlets of the air paths 71*c*, thereby facilitating the movement of the airflow in the air paths 71*c* desirably.

In the printers according to the embodiment and the first and second embodiment examples, the cover frame 52 has thereon not only the first air openings 52*f* serving as the first openings facing the exhaust fans 96 serving as air exhaust units with the optical writing unit 70 set in the write position, but also the second air openings 52*g* serving as the second openings not facing the exhaust fans 96. Further, the optical system unit 71 is held in the cover frame 52 such that the airflow inlets of the air paths 71*c* face the second air openings 52*g* and the airflow outlets of the air paths 71*c* face the first air openings 52*f*. With this structure, the air moved from near the inlet group 95*b* to the second air openings 52*g* of the second frame 52*e* is received into the air paths 71*c* smoothly, thereby facilitating the movement of the airflow in the air paths 71*c*. Further, the airflow discharged from the airflow outlets of the air paths 71*c* is received into the first air openings 52*f* of the first frame 52*d* smoothly, thereby facilitating the movement of the airflow in the air paths 71*c*.

In the printers according to the embodiment and the first and second embodiment examples, the photosensitive elements (2Y, 2M, 2C, and 2K) are provided. Further, as a transfer unit, the transfer unit 15 is used that superimposes toner images on the surfaces of the photosensitive elements and transfers them to the intermediate transfer belt 16 serving as a transfer member. With this structure, the toner images on the photosensitive elements are superimposed, so that a multi-color image is formed.

In the printers according to the embodiment and the first and second embodiment examples, on the outer cover 95 constituting a part of the chassis is provided the inlet group 95*b* that takes air into the chassis, before the air to be discharged by the exhaust fans 96 to the outside of the chassis. This structure prevents degradation in discharging performance when air cannot be taken into the chassis. Further, the exhaust fans 96 can serve as intake fans by being reversely rotated, and the inlet group 95*b* can serve as an outlet group, thereby preventing degradation in discharging performance when air cannot be discharged from inside the chassis.

In the printers according to the first and second embodiment examples, the photosensitive elements 2Y, 2M, 2C, and 2K are used that carry latent images on the peripheries of their rotatable cylinders. Further, the airflow paths from the inlet group 95*b* to the exhaust fans 96 through the second air openings 52*g*, the air paths 71*c*, and the first air openings 52*f* are provided in straight lines along the rotational axis direction of the photosensitive elements. With this structure, the movement of the airflow in the air paths 71*c* can be more activated, compared with a structure in which the paths are curved. Further, even when the exhaust fans 96 rotate reversely so as to serve as intake fans, the same advantage can be achieved because the airflow paths from the fans to the outlet group through the first air openings 52*f*, the air paths 71*c*, and the second air openings 52*g* are arranged in straight lines.

In the printers according to the first and second embodiment examples, as the supporting unit, a chassis is used that supports the optical writing unit 70 to be pivotable between the write position and the retract position. Further, the extension direction of the airflow paths provided in straight lines is oriented along the axis direction of the pivoting movement of the optical writing unit 70. With this structure, the optical writing unit 70 can pivot with its orientation constantly parallel to the extension direction of the air paths 71*c*.

In the printers according to the embodiment and the first and second embodiment examples, the upper cover 50 constituting a part of the chassis and serving as an opening-and-closing cover is fixed to the optical writing unit 70, and the maintenance opening of the chassis is opened and closed by opening and closing the upper cover 50 together with the optical writing unit 70. This structure allows the optical writing unit 70 to pivot from the write position to the retract position according to the opening and closing operation performed by the upper cover 50.

Further, the printer according to the second embodiment example includes a facing member that faces a space between the upper cover 50 with the maintenance opening of the chassis closed, and the left plate constituting a portion of the chassis and being close to the upper cover 50. With this structure, the smooth movement of the airflow drawn through the space can be blocked by the fourth frame 52*h* as described, enabling to prevent degradation in cooling performance due to the occurrence of the turbulent flow.

In the printer according to the second embodiment example, a portion of the cover frame 52 serves as the facing member. This structure allows cost reduction, compared with a structure in which the cover frame 52 and the facing member are separately provided.

In the printers according to the embodiment and the first and second embodiment examples, the upper cover 50 constituting a part of the chassis is fixed to the optical writing unit 70, and the maintenance opening of the chassis is opened and closed according to the movement of the optical writing unit (image writing unit) 70 between the write position and the retract position. Further, the outer surface section of the upper cover 50 serves as the sheet stacking section having thereon the stacked recording sheets, i.e., the recording sheets P, to which toner images are transferred from the photosensitive elements. This structure allows cost reduction, compared with a structure in which the sheet stacking section is separately provided from the outer cover including the upper cover 50.

In the printer according to the second embodiment example, the air paths 71*c* are provided that allow the airflow received through the airflow inlets at one ends to contact the upper cover 50 and the optical system unit 71, thereby discharging the airflow toward the airflow outlets at the other ends. Further, the optical system unit 71 is held in the cover frame 52 such that the airflow inlets of the air paths 71*c* face the second air openings 52*g* of the second frame 52*e* and that the airflow outlets of the air paths 71*c* face the first air openings 52*f* of the first frame 52*d*. With this structure, even when a large volume of the recording sheets P heated through the fixing process are stacked on the sheet stacking section and heat is accumulated on the upper cover 50, heat transfer from the upper cover 50 to the optical system unit 71 can be suppressed by cooling the upper cover 50.

As described above, according to one aspect of the present invention, by retracting a image writing unit from the write position as necessary, a device hidden in the back of the image writing unit is exposed, so that the maintenance is improved.

Furthermore, as the image writing unit is set to the write position, the image writing unit freely moves above a holding unit while causing a hitting portion of its optical system unit to hit a blocking portion in the chassis of the image forming apparatus. This structure enables desirable positioning of the optical system unit.

Moreover, with the image writing unit set in the write position, an air intake unit or an air exhaust unit faces the optical system unit through the openings provided on the holding unit. In this way, the airflow taken into the chassis by the air intake unit is directly blown to the optical system unit through the openings, or the air inactivated around the optical system unit is directly drawn into the air exhaust unit through the openings. By such blowing and drawing, the airflow can be brought into contact with the surface of the optical system unit, thereby cooling the optical system unit. Accordingly, degradation in write accuracy due to temperature increase in the optical system unit is suppressed without pulling the duct in the chassis. This structure suppresses degradation in write accuracy, while downsizing the apparatus by omitting the duct.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier on which a latent image is formed;

an image writing unit that writes the latent image on a surface of the image carrier with a write light output in a state in which the image writing unit is set in a write position;

a supporting unit that supports the image writing unit in such a manner that the image writing unit is retractable from the write position;

a developing device that develops the latent image formed on the image carrier to obtain a visible image;

a chassis that contains the image carrier, the image writing unit, and the developing device; and either one of an air intake unit that generates intake air by sending air into the chassis from outside and an air exhaust unit that generates exhaust air by sending air from inside of the chassis to the outside, wherein the image writing unit includes an optical system unit containing an optical system element in a unit case, and a holding unit that holds the optical system unit in a movable manner, the holding unit being supported by the supporting unit, the image writing unit causes, upon being set in the write position, the optical system unit to be movable and positions the optical system unit, with a hitting portion of the optical system unit hitting a blocking portion in the chassis, the holding unit includes, in the state in which the image writing unit is set in the write position, a portion defining an opening that faces either one of the air intake unit and the air exhaust unit, and the air intake unit blows the intake air to the optical system unit through the opening, or the air exhaust unit draws the exhaust air around the optical system unit through the opening.

2. The image forming apparatus according to claim 1, wherein the holding unit is formed with a frame body without a sealed space having the opening, and the optical system unit is held inside the frame body.

3. The image forming apparatus according claim 1, wherein the unit case includes a tubular air path passing through the unit case, the tubular air path having an inner wall contacting an air outside of the case and an outer wall contacting an air inside of the case.

4. The image forming apparatus according to claim 3, wherein the optical system unit is held by the holding unit in such a manner that that either one of an airflow inlet or an airflow outlet at one end of the air path in an airflow direction faces the opening.

5. The image forming apparatus according to claim 4, wherein the opening serves as a first opening, the holding unit further includes a portion defining a second opening not facing the air intake unit nor the air exhaust unit with the holding unit set in the write position, and the optical system unit is held in the holding unit in such a manner that one of the airflow inlet and the airflow outlet of the air path faces the first opening, and that other of the airflow inlet or the airflow outlet faces the second opening.

6. The image forming apparatus according to claim 5, wherein a plurality of image carriers is provided, and the image forming apparatus further comprises a transfer unit that transfers visible images on the image carriers onto a transfer member in a superimposing manner.

7. The image forming apparatus according to claim 6, wherein the chassis includes either one of an outlet that discharges air taken into the chassis by the air intake unit to the outside of the chassis and an inlet that takes air into the chassis before the air is discharged to the outside of the chassis by the air exhaust unit.

8. The image forming apparatus according to claim 7, wherein each of the image carriers has a rotatable cylinder to carry a latent image on a its periphery, and either one of an airflow path from the air intake unit to the outlet through the first opening, the air path, and the second opening and an airflow path from the inlet to the air exhaust unit through the second opening, the air path, and the first opening is provided in a straight line along a rotational axis direction of the cylinder.

9. The image forming apparatus according to claim 8, wherein the supporting unit supports the image writing unit to move between the write position and the retract position, and an extension direction of the path along a straight line is arranged to be parallel to a moving axis direction of the image writing unit.

10. The image forming apparatus according to claim 9, wherein an opening/closing cover constituting a part of the chassis is directly or indirectly fixed to the image writing unit, and a movement of the opening/closing cover together with the image writing unit opens and closes a maintenance opening of the chassis.

11. The image forming apparatus according to claim 10, further comprising a facing member that faces a space between the opening/closing cover with the maintenance opening closed and a portion of the chassis close to the opening/closing cover.

12. The image forming apparatus according to claim 11, wherein the holding unit includes a portion serving as the facing member.

13. The image forming apparatus according to claim 1, wherein an opening/closing cover constituting a part of the chassis is directly or indirectly fixed to the image writing unit, a maintenance opening of the chassis opens and closes with a movement of the image writing unit between the write position and the retract position, and the opening/closing cover includes an outer surface serving as a sheet stacking unit on which a recording sheet onto which the visible image is transferred from the image carrier directly or via an intermediate transfer member.

14. The image forming apparatus according to claim 13, further comprising an air path that causes an airflow input at an airflow inlet at one end to contact the opening/closing cover and the optical system unit and to output toward an airflow outlet at the other end, wherein the optical system unit is held in the holding unit in such a manner that either one of the airflow inlet and the airflow outlet of the air path faces the opening.

* * * * *